US009102050B2

(12) United States Patent
Su

(10) Patent No.: US 9,102,050 B2
(45) Date of Patent: Aug. 11, 2015

(54) LENGTH ADJUSTABLE TOOL

(71) Applicant: Cheng-Wei Su, Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 396 days.

(21) Appl. No.: 13/684,768

(22) Filed: Nov. 26, 2012

(65) Prior Publication Data

US 2014/0145127 A1 May 29, 2014

(51) Int. Cl.

| | |
|---|---|
| ***B66F 3/00*** | (2006.01) |
| ***B25B 23/16*** | (2006.01) |
| ***B25G 1/00*** | (2006.01) |
| ***B25G 1/04*** | (2006.01) |
| ***B66F 15/00*** | (2006.01) |
| *B25B 23/00* | (2006.01) |

(52) U.S. Cl.

CPC . *B25G 1/04* (2013.01); *B66F 15/00* (2013.01); *B25B 23/0021* (2013.01); *Y10T 16/473* (2013.01)

(58) Field of Classification Search

CPC ..... B25G 1/04; B25G 1/043; B66F 15/00; B23B 41/12; B23B 47/28; B23B 23/0021; B23B 23/0035

USPC ..... 254/129, 131, 131.5, 21, 25, 26 R, 19, 254/26 E; 16/429; 81/436, 438, 177.2

See application file for complete search history.

(56) References Cited

U.S. PATENT DOCUMENTS

| | | | | |
|---|---|---|---|---|
| 5,285,702 | A * | 2/1994 | Hillinger | 81/177.2 |
| 7,878,094 | B2 * | 2/2011 | Lin | 81/177.2 |
| 8,739,662 | B2 | 6/2014 | Huang | |
| 2007/0131070 | A1 * | 6/2007 | Hull et al. | 81/489 |

FOREIGN PATENT DOCUMENTS

| | | |
|---|---|---|
| CN | 2654284 Y | 11/2004 |
| TW | 554799 U | 9/2003 |

* cited by examiner

*Primary Examiner* — Lee D Wilson
*Assistant Examiner* — Seahee Yoon
(74) *Attorney, Agent, or Firm* — Alan D. Kamrath; Kamrath IP Lawfirm, P.A.

(57) ABSTRACT

A length adjustable tool includes a first extending member including first and second ends thereof opposite to each other, with the first end thereof forming a first driving end. A second extending member includes first and second ends thereof opposite to each other, with first extending member slidably and non-rotatably engaged therewith, with the second end thereof forming a second driving end. A positioning mechanism engages with the first and second extending members and is operable to a first position in which the first and second extending members are stopped from sliding relative to each other and a second position in which the first and second extending members are slidable relative to each other.

20 Claims, 11 Drawing Sheets

LENGTH ADJUSTABLE TOOL

BACKGROUND OF THE INVENTION

1. Field of the Invention

The present invention relates to a length adjustable tool and, in particular, to a length adjustable tool including members that are able to be moved relative to each other for various lengths of the length adjustable tool and that the members will not loosen from one another.

2. Description of the Related Art

TW Patent No. 554,799 teaches an extension bar of a hand tool including a handle, a sleeve, and a bar. The handle is inserted through the sleeve. The sleeve and the bar are fixed together. The sleeve includes a resilient ring, a stopping rod, and a toothed member disposed therein. In use of the extension bar of the hand tool, the handle and the bar are operably rotatable relative to each other, with the sleeve and the bar rotated together. A user can rotate the handle relative to the bar in a first direction until the toothed member and the stopping rod tightly abut against an inner periphery of the sleeve, thereby making the handle disposed at a fixed position relative to the bar. Also, the handle and the bar can be released from a fixed relative position by rotating the handle relative to the bar in a second direction opposite to the first direction.

However, it is easy that the handle and the bar will loosen from each other while the user operates the hand tool, because it is liable that a user transmits a force that causes the handle and the bar to rotate relative each other inadvertently in a direction causing' ausing the handle and the bar released from a fixed relative position when the hand tool is operably rotated, and the user is likely to lose a firm grip of the hand tool during the operation thereof. This can be very dangerous for the user, and the object to be driven can be damaged. Also, a user can not judge how much the handle and the bar are moved relative to each other without a ruler, a tape ruler, or a length measuring gauge.

The present invention is, therefore, intended to obviate or at least alleviate the problems encountered in the prior art.

SUMMARY OF THE INVENTION

According to the present invention, a length adjustable tool includes a first extending member including first and second ends thereof opposite to each other, with the first end thereof forming a first driving end. A second extending member includes first and second ends thereof opposite to each other, with first extending member slidably and non-rotatably engaged therewith, and with the second end thereof forming a second driving end. A positioning mechanism engages with the first and second extending members and is operable to a first position in which the first and second extending members are stopped from sliding relative to each other and a second position in which the first and second extending members are slidable relative to each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objects, advantages, and new features of the present invention will become apparent from the following detailed description of the invention when considered in conjunction with the accompanied drawings.

DETAILED DESCRIPTION OF THE INVENTION

Figure 1:
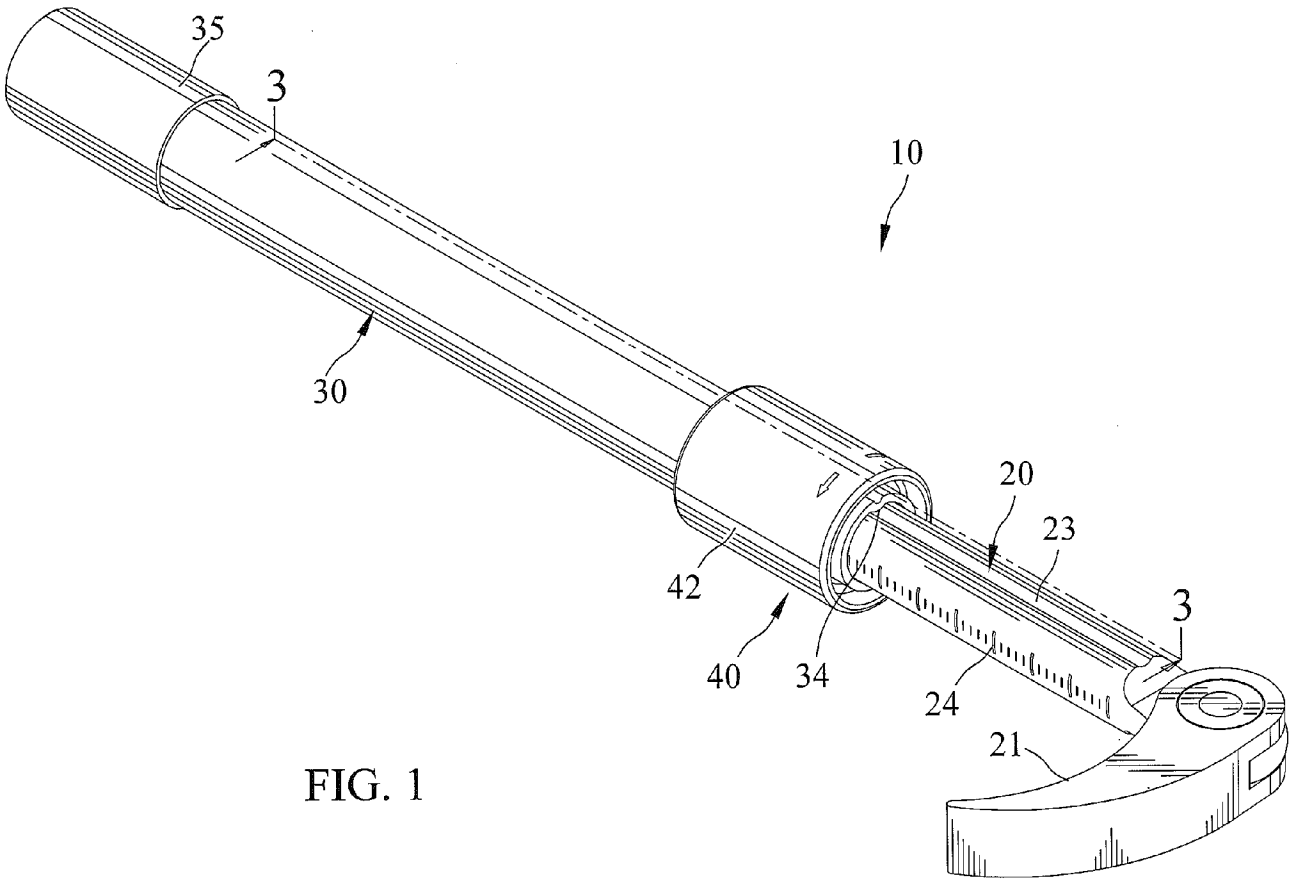
FIG. 1 is a perspective view of a length adjustable tool in accordance with a first embodiment of the present invention.
Figure 2:
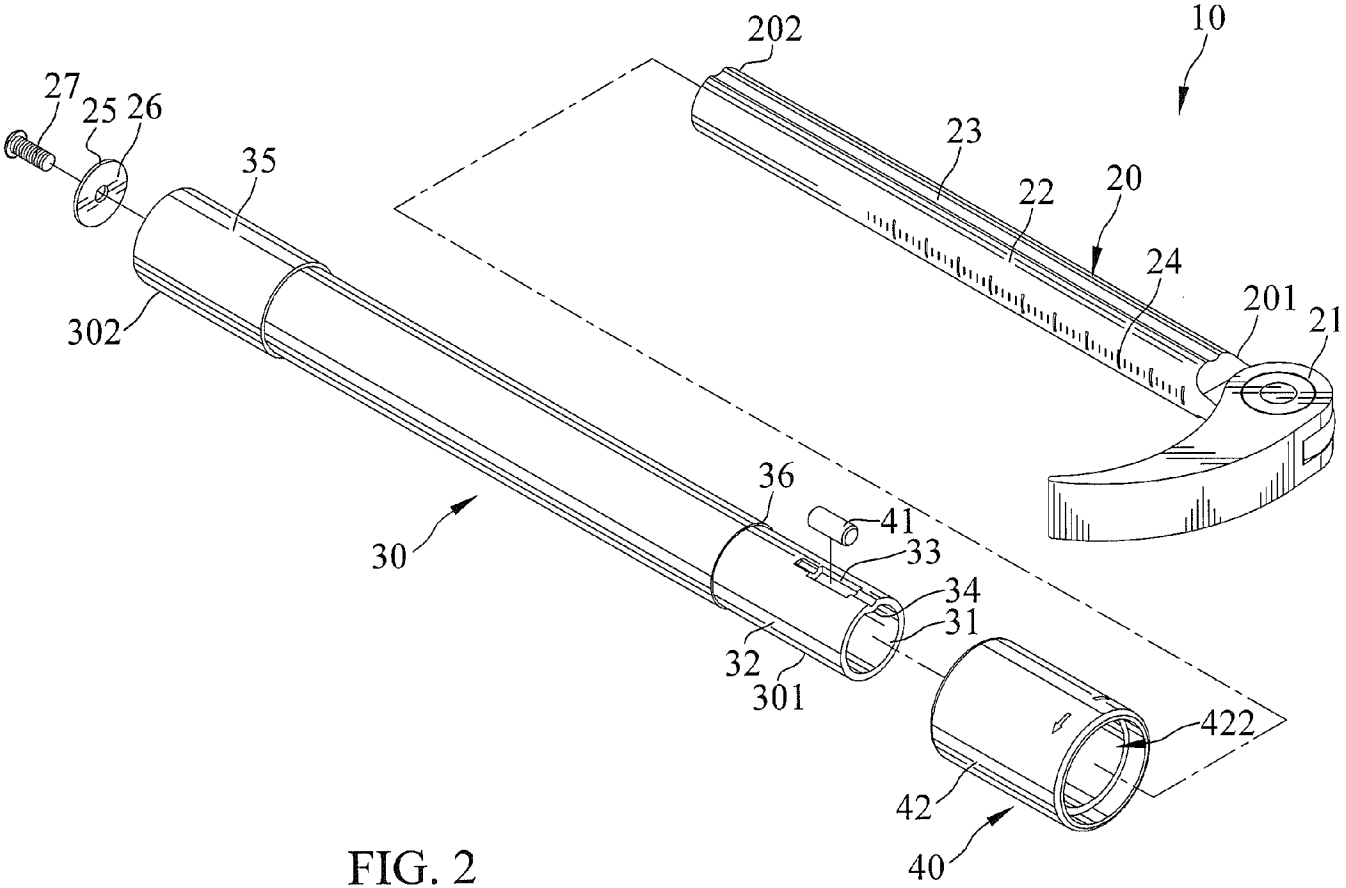
FIG. 2 is an exploded perspective view of the length adjustable tool of FIG. 1.
Figure 3:
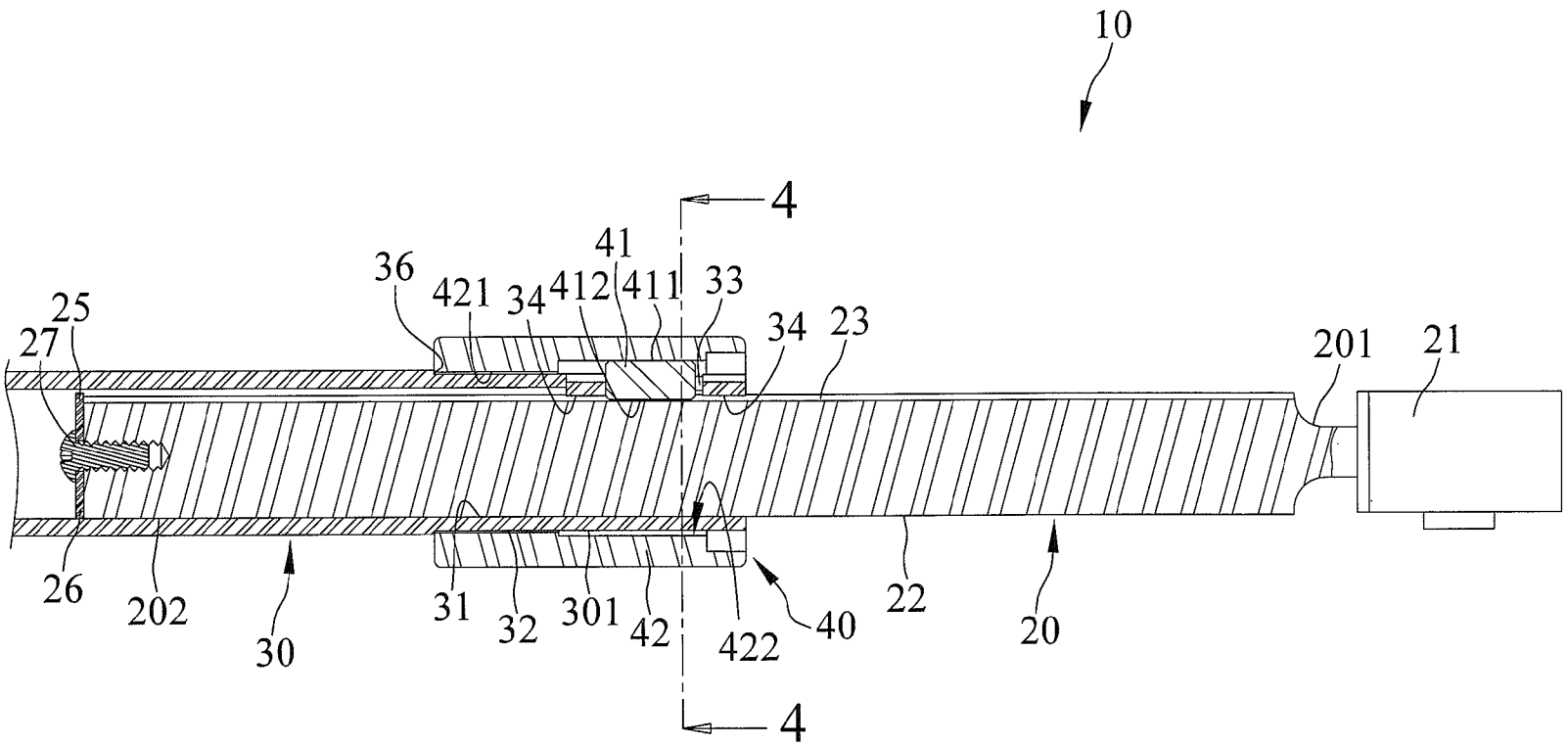
FIG. 3 is a cross-sectional view taken along line 3-3 of FIG. 1.
Figure 4:
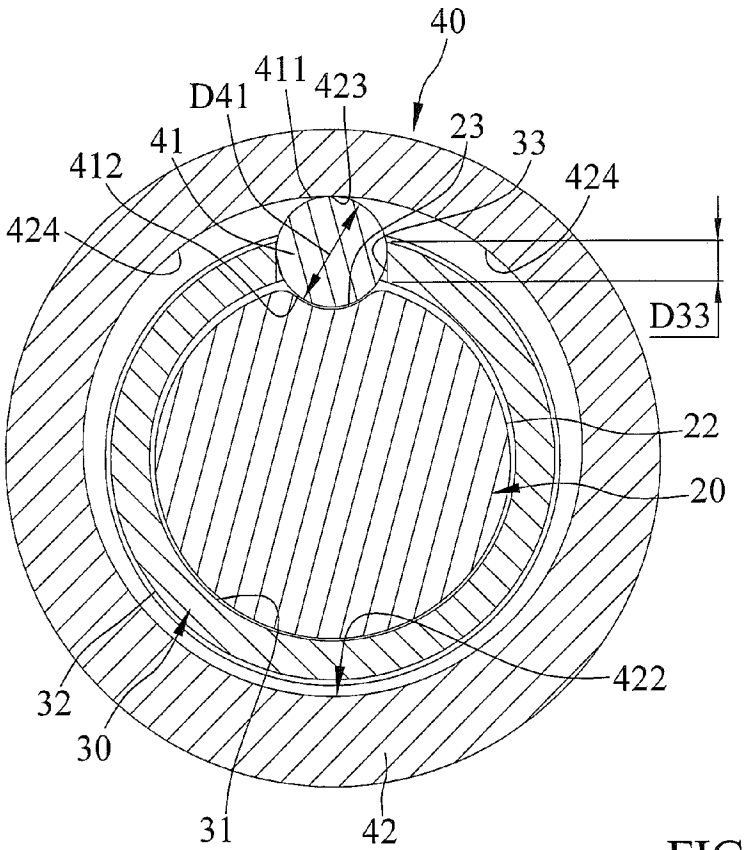
FIG. 4 is a cross-sectional view taken along line 4-4 of FIG. 3.
Figure 5:
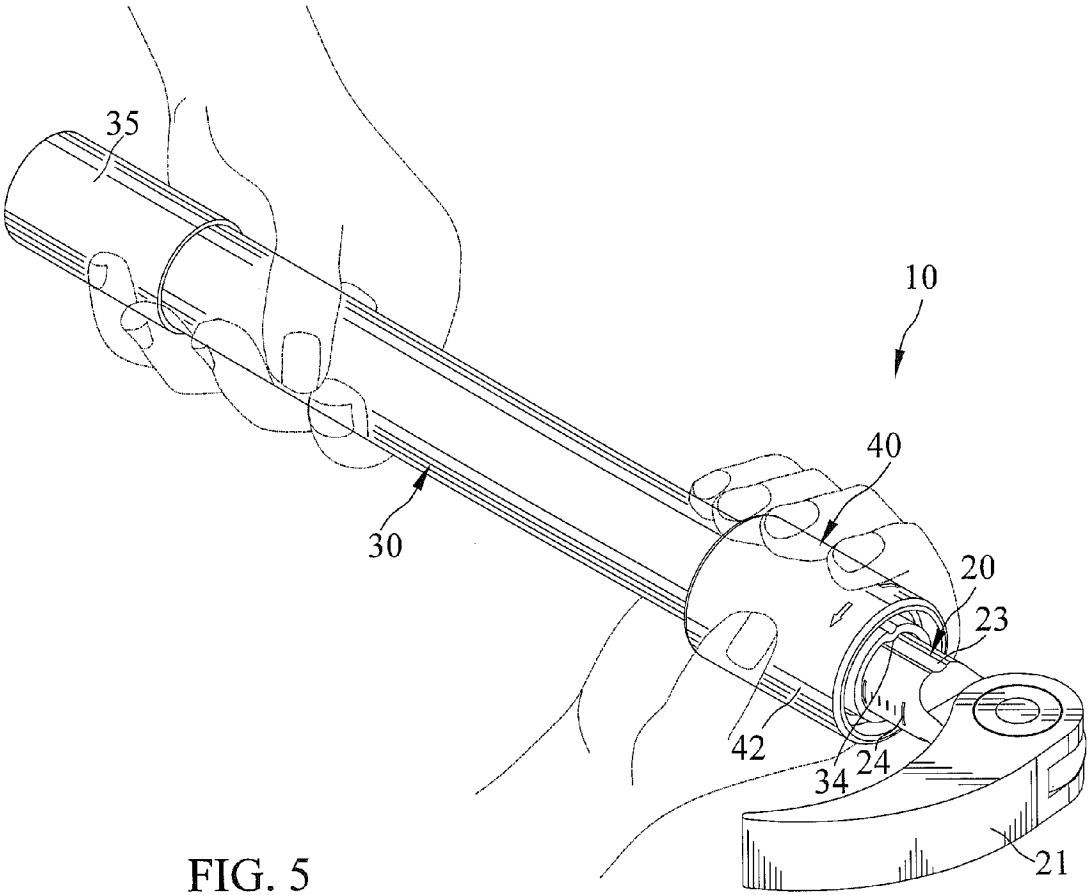
FIG. 5 is a perspective view of the length adjustable tool of FIG. 1, with the length adjustable tool adjusted to a length different than that shown in FIG. 1, with the length adjustable tool in a first mode adjusted adjustable to various lengths, and with hands holding the length adjustable tool shown in phantom.
Figure 6:
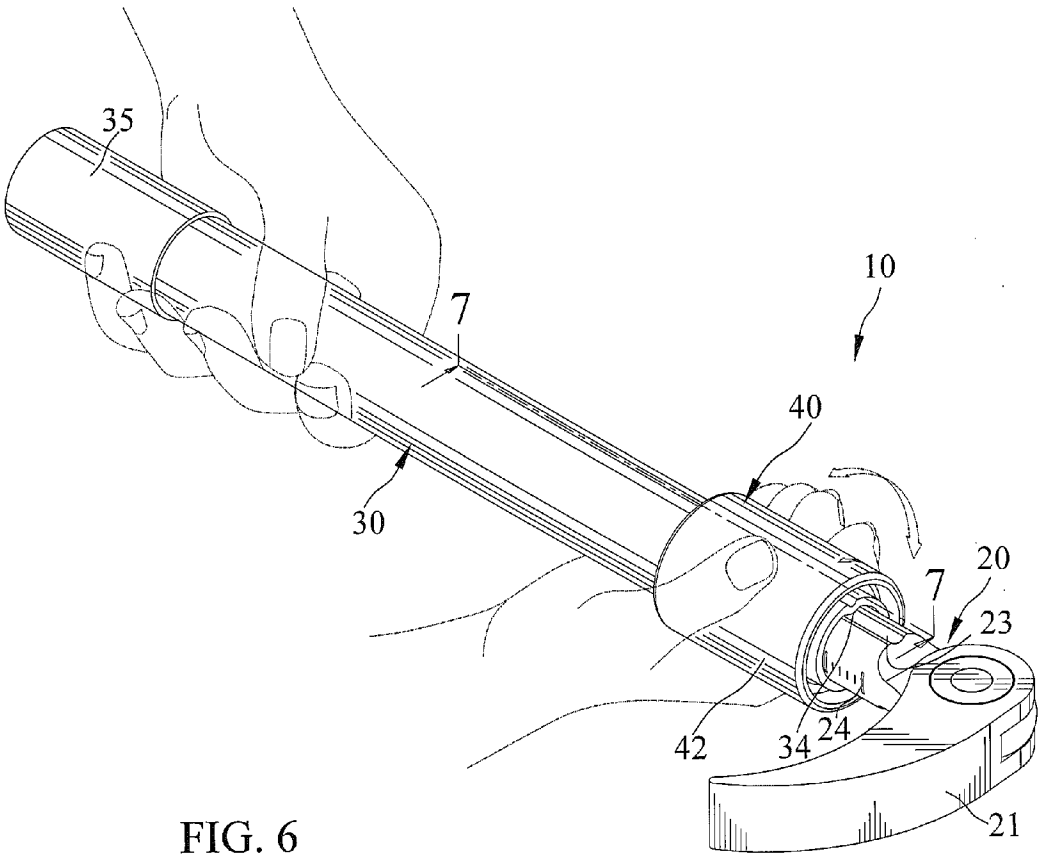
FIG. 6 is a continued view of FIG. 5, with the length adjustable tool adjusted in a second mode fixed to a predetermined length shown in FIG. 5, and with the arrow shown in phantom indicating the length adjustable tool being changed from the first mode to the second mode.
Figure 7:
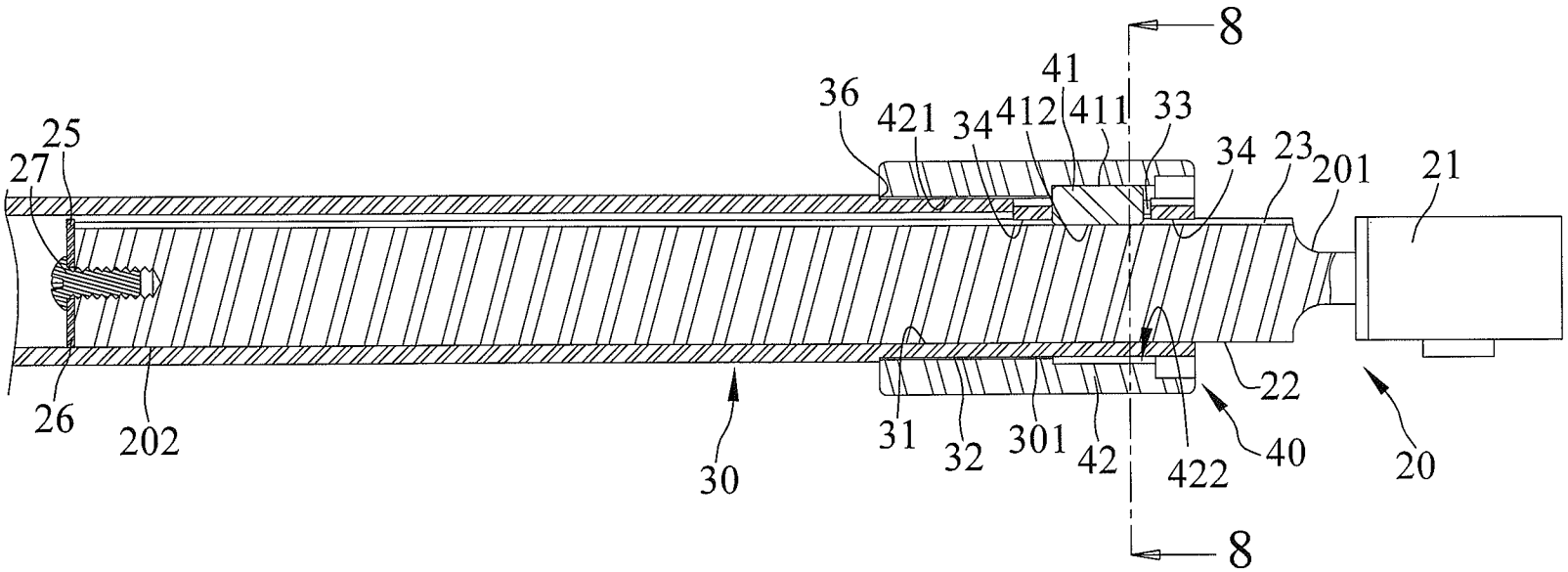
FIG. 7 is a cross-sectional view taken along line 7-7 of FIG. 6.
Figure 8:
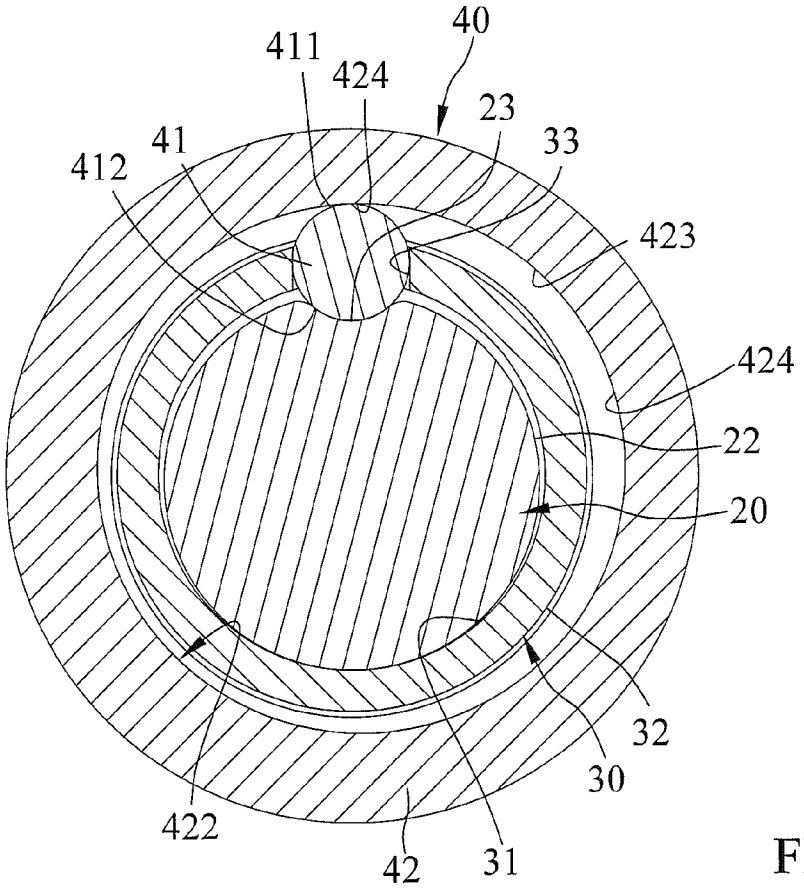
FIG. 8 is a cross-sectional view taken along line 8-8 of FIG. 7.

FIGS. 1 through 8 show a length adjustable tool 10 in accordance with a first embodiment of the present invention.

The length adjustable tool 10 includes a first extending member 20, a second extending member 30, and a positioning mechanism 40.

The first extending member 20 includes first and second ends 201 and 202 thereof opposite to each other, with the first end 201 thereof forming a first driving end 21. The first driving end 21 forms an extension adapted to be pivotal with respect to the first extending member 20 when the length adjustable tool 10 is used as a pry bar, with the extension engaged with an object to be worked with. However, this is not limiting. The first extending member 20 includes an outer periphery 22 thereof including a limiting section 23 extended laterally in a direction from the first end 201 to the second end 202 thereof. Furthermore, the first extending member 20 includes the outer periphery 22 thereof defining first and second portions, with the first portion defining an extent of the limiting section 23, and with the second portion having a cross section that is substantial circular. The first extending member 20 also includes the outer periphery 22 thereof including length markings 24 disposed in a direction from the first end 201 to the second end 202 thereof. The first extending member 20 includes the second end 202 thereof including a stopper 25. The stopper 25 is in the form of a block 26. The block 26 is separately formed from the first extending member 20. The block 26 is securely mounted on the first extending member 20 by at least one fastening member 27. However, the stopper 25 can also be made with the first extending member 20 integral.

The second extending member 30 includes first and second ends 301 and 302 thereof opposite to each other, with the second end 302 thereof forming a second driving end 35. The first extending member 20 is slidably and non-rotatably engaged with the second extending member 30. The second extending member 30 includes inner and outer peripheral edges 31 and 32. The second extending member 30 includes a receptacle 33 extended laterally and through the inner and outer peripheral edges 31 and 32 thereof. The second extending member 30 includes the inner peripheral edge 31 thereof forming a stopping section 34 preventing the first and second extending members 20 and 30 being rotated relative each other. The stopping section 34 corresponds to the limiting section 23. The stopping section 34 forms a convex surface, and the limiting section 23 forms a concave surface, respectively. The second extending member 30 includes the inner peripheral edge 31 thereof defining first and second portions, with the first portion defining an extent of the stopping section 34, and with the second portion having a cross section that is substantial circular. The second extending member 30 includes the inner peripheral edge 31 delimiting a chamber into which the first extending member 20 is inserted. The stopper 25 is movably received in the chamber. The second extending member 30 includes the outer peripheral edge 32 thereof including a flange 36.

The positioning mechanism 40 is engaged with the first and second extending members 20 and 30. The positioning mechanism 40 is operable to a first position in which the first and second extending members 20 and 30 are stopped from sliding relative to each other and a second position in which the first and second extending members 20 and 30 are slidable relative to each other. The positioning mechanism 40 includes a retaining member 41 and a control member 42. The retaining member 41 is disposed in the receptacle 33. The control member 42 is slidably engaged with the second extending member 30. The retaining member 41 is selectively moved by the control member 42 to abut against the limiting section 23. The retaining member 41 is moved radially with respect to the first extending member 20 to selectively abut against the limiting section 23. The receptacle 33 has a depth D33. The retaining member 41 has a diameter D41 greater than the depth D33. The retaining member 41 includes first and second abutting sections 411 and 412 disposed outside the receptacle 33. The first abutting section 411 and the second abutting section 412 are respectively extended outside the inner peripheral edge 31 and the outer peripheral edge 32 of the second extending member 30. The stopper 25 is selectively stopped by the retaining member 41. The first extending member 20 is stopped from moving out of and disengaging from the second extending member 30 when the stopper 25 abuts against the retaining member 41. The control member 42 is abutted against the retaining member 41 on the first abutting section 411. The control member 42 is restrained on the second extending member 30 by the flange 36 and the first abutting section 411. The second abutting section 412 is selectively abutted against the limiting section 23. The control member 42 includes an eccentric hole 422 including a periphery against which the first abutting section 411 of the retaining member 41 abuts. The first abutting section 411 is selectively abutted against a deep section 423 and a shallow section 424 of the eccentric hole 422. The shallow section 424 is adjacent to the deep section 423. The second abutting section 412 of the retaining member 41 is selectively abutted against the limiting section 23 when the first abutting section 411 is selectively abutted against the deep section 423 and the shallow section 424. The control member 42 includes a hole 421 in which the second extending member 30 is pivotally engaged. The shallow section 424 is more closely spaced from the outer peripheral edge 32 of the second extending member 30 than the deep section 423. The shallow section 424 is extended from two opposite sides of the deep section 423. The first abutting section 411 is abutted against the shallow section 424 when the positioning mechanism 40 is operated to the first position and which causes the second abutting section 412 to be in a position abutting against the limiting section 23. The first abutting section 411 is abutted against the deep section 423 when the positioning mechanism 40 is operated to the second position and which causes the second abutting section 412 to be in a position not abutting against the limiting section 23.

Figure 9:
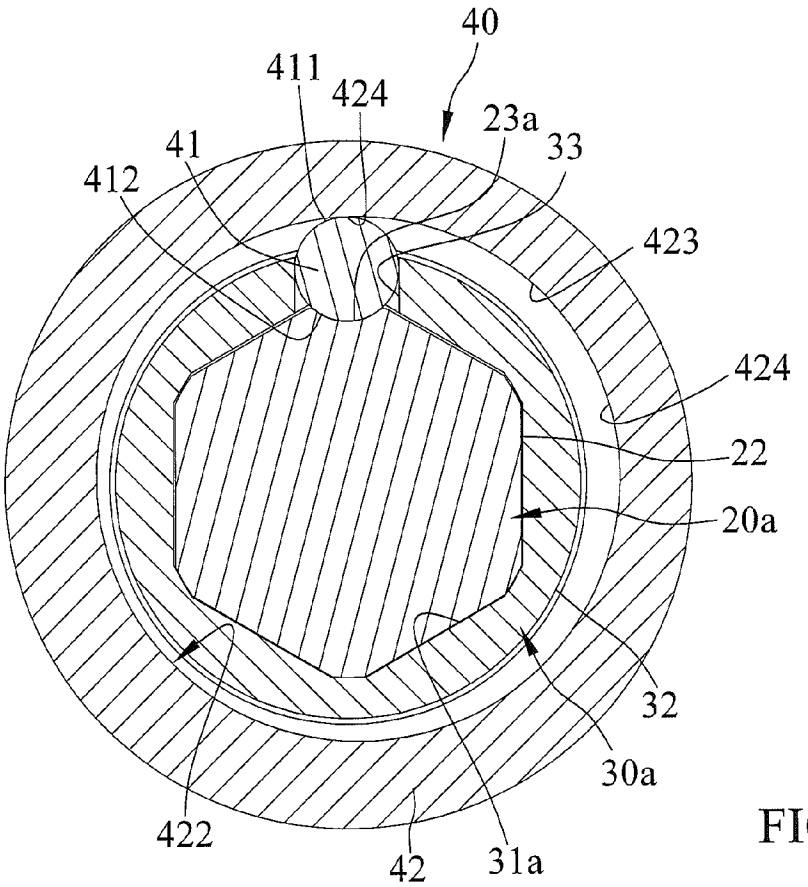
FIG. 9 is a cross-sectional view of a length adjustable tool in accordance with a second embodiment of the present invention.
Figure 10:
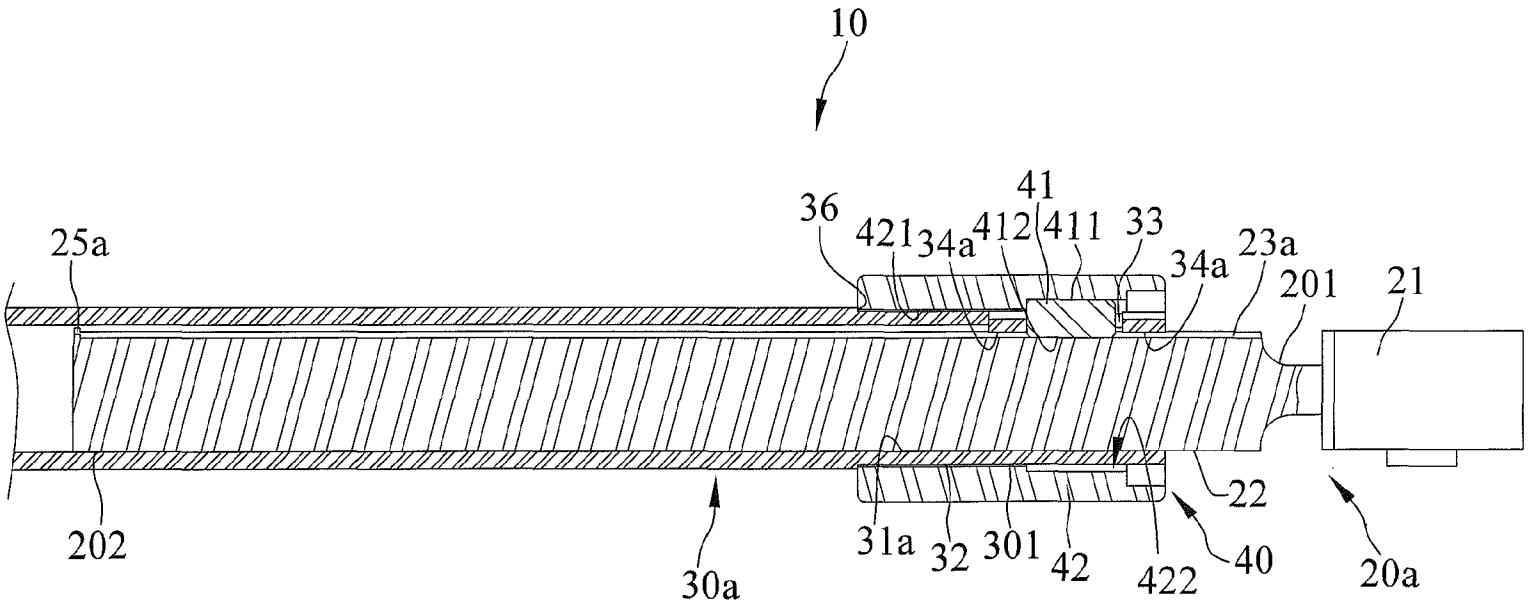
FIG. 10 is another cross-sectional view of the length adjustable tool of the second embodiment of the present invention.

FIGS. 9 and 10 show a length adjustable tool in accordance with a second embodiment of the present invention, and the same numbers are used to correlate similar components of the first embodiment, but bearing a letter Flail "a". The second embodiment is similar to the first embodiment except it substitutes a first extending member 20*a* with the first extending member 20 and a second extending member 30*a* with the second extending member 30, respectively. The first extending member 20*a* includes an outer periphery thereof having a cross section that is polygonal. The second extending member 30*a* includes an inner peripheral edge 31*a* thereof having a cross section that is polygonal. A limiting section 23*a* is inset into a corner of two adjacent sides of the outer periphery of the first extending member 20*a*. The first extending member 20*a* includes the outer periphery thereof having a hexagonal cross section. The second extending member 30*a* includes the inner peripheral edge 31*a* thereof having a hexagonal cross section. A stopping section 34*a* forms a flat surface and the limiting section 23*a* forms a flat surface, respectively. Further, a stopper 25*a* is made with the first extending member 20*a* integrally.

Figure 11:
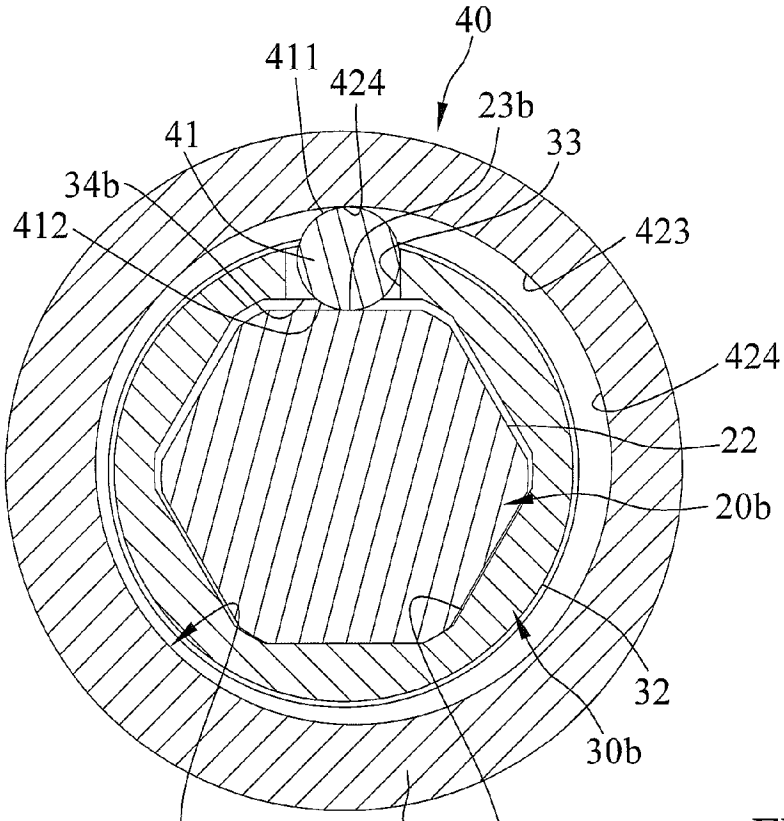
FIG. 11 is a cross-sectional view of a length adjustable tool in accordance with a third embodiment of the present invention.

FIG. 11 show a length adjustable tool in accordance with a third embodiment of the present invention, and the same numbers are used to correlate similar components of the first embodiment, but bearing a letter "b". The third embodiment is similar to the first embodiment, except it substitutes a first extending member 20*b* with the first extending member 20 and a second extending member 30*b* with the second extending member 30, respectively. The first extending member 20*b* includes an outer periphery thereof having a cross section that is polygonal. The second extending member 30*b* includes an inner peripheral edge 31*b* thereof having a cross section that is polygonal. A limiting section 23*b* is defined on a flat side of the outer periphery of the first extending member 20*b*. The first extending member 20*b* includes the outer periphery thereof having a hexagonal cross section. The second extending member 30*b* includes the inner peripheral edge 31*b* thereof having a hexagonal cross section. A stopping section 34*b* forms a flat surface, and the limiting section 23*b* forms a flat surface, respectively.

In view of the forgoing, the length adjustable tool 10 does not suffer a problem set forth in the Description of the Related Art as the first extending member 20, 20*a* and 20*b* can not be rotated relative to the second extending member 30, 30*a* and 30*b* and that the positioning mechanism 40 is not inadvertently moved from the first position to the second position by the first extending member 20, 20*a* and 20*b* or the second extending member 30, 30*a* and 30*b*. A user can accurately judge how much the first extending member 20, 20*a* and 20*b* is moved relative to the second extending member 30, 30*a* and 30*b*. Furthermore, the length adjustable tool 10 has a simple structure.

While the specific embodiments have been illustrated and described, numerous modifications come to mind without significantly departing from the spirit of invention, and the scope of invention is only limited by the scope of accompanying claims.

What is claimed is:

1. A length adjustable tool comprising:

a first extending member including first and second ends thereof opposite to each other and spaced in a direction from the first end to the second end, with the first end thereof forming a first driving end;

a second extending member including first and second ends thereof opposite to each other, with first extending member slidably and non-rotatably engaged with the second extending member and slideable relative to the second extending member in the direction, with the second end of the second extending member forming a second driving end; and a positioning mechanism including a control member and a retaining member, with the control member rotatably engaging with the first and second extending members, with the control member including an eccentric hole having cross sections perpendicular to the direction of an eccentric shape, with the retaining member received in the eccentric hole, with the control member rotationally operable to a first position in which the first and second extending members are stopped from sliding in the direction relative to each other and a second position in which the first and second extending members are slidable in the direction relative to each other.

2. The length adjustable tool as claimed in claim 1, wherein the first extending member includes an outer periphery thereof including a limiting section extended laterally in Ran the direction from the first end to the second end thereof, wherein the second extending member includes an inner peripheral edge and an outer peripheral edge, with the inner peripheral edge delimiting a chamber into which the first extending member is inserted, wherein the second extending member includes a receptacle extended laterally and through the inner and outer peripheral edges thereof, with the retaining member disposed in the receptacle, with the control member slidably and rotatably engaged with the second extending member, with the retaining member selectively moved by the control member to abut against the limiting section.

3. The length adjustable tool as claimed in claim 2, wherein the retaining member includes first and second abutting sections disposed outside the receptacle, with the first abutting section and the second abutting section respectively extended outside the outer peripheral edge and the inner peripheral edge of the second extending member, with the control member abutted against the retaining member on the first abutting section, and with the second abutting section selectively abutted against the limiting section.

4. The length adjustable tool as claimed in claim 3, wherein the eccentric hole includes a periphery against which the first abutting section of the retaining member abuts, with the first abutting section selectively abutted against a deep section and a shallow section of the eccentric hole, with the first and second extending members being intermediate the deep and shallow sections, with the shallow section adjacent to the deep section, and wherein the second abutting section of the retaining member is selectively abutted against the limiting section when the first abutting section is selectively abutted against the deep section and the shallow section.

5. The length adjustable tool as claimed in claim 4, wherein the control member includes a hole in which the second extending member is slideably and rotatably received, wherein the shallow section is more closely spaced from the outer peripheral edge of the second extending member than the deep section, wherein the shallow section is extended from two opposite sides of the deep section, wherein the first abutting section is abutted against the shallow section when the control member is rotationally operated to the first position and which causes the second abutting section to be in a position abutting against the limiting section, and wherein the first abutting section is abutted against the deep section when the control member is rotationally operated to the second position and which causes the second abutting section to be in a position not abutting against the limiting section.

6. The length adjustable tool as claimed in claim 5, wherein the second extending member includes the outer peripheral edge thereof including a flange, and wherein the control member is restrained on the second extending member by the flange and the first abutting section.

7. The length adjustable tool as claimed in claim 1, wherein the first extending member includes an outer periphery thereof including length markings disposed in the direction from the first end to the second end thereof.

8. The length adjustable tool as claimed in claim 7, wherein the first driving end forms an extension pivotal with respect to the first extending member when the length adjustable tool is used as a pry bar, with the extension engaged with an object to be worked with.

9. The length adjustable tool as claimed in claim 2, wherein the first extending member includes the second end thereof including a stopper, and wherein the stopper is movably received in the chamber of the second extending member and selectively stopped by the retaining member, with the first extending member stopped from moving out of and disengaging from the second extending member when the stopper abuts against the retaining member.

10. The length adjustable tool as claimed in claim 2, wherein the second extending member includes the inner peripheral edge thereof forming a stopping section preventing the first and second extending members from being rotated relative each other, with the stopping section corresponding to the limiting section.

11. The length adjustable tool as claimed in claim 9, wherein the second extending member includes the inner peripheral edge thereof forming a stopping section preventing the first and second extending members from being rotated relative each other, with the stopping section corresponding to the limiting section.

12. The length adjustable tool as claimed in claim 10, wherein stopping section forms a convex surface and the limiting section forms a concave surface, respectively.

13. The length adjustable tool as claimed in claim 10, wherein the stopping section forms a flat surface and the limiting section forms a flat surface, respectively.

14. The length adjustable tool as claimed in claim 10, wherein the first extending member includes the outer periphery thereof defining first and second portions, with the first portion defining an extent of the limiting section, with the second portion having a cross section perpendicular to the direction that is substantial circular, and wherein the second extending member includes the inner peripheral edge thereof defining first and second portions, with the first portion defining an extent of the stopping section, with the second portion having a cross section perpendicular to the direction that is substantial circular.

15. The length adjustable tool as claimed in claim 10, wherein the first extending member includes the outer periphery thereof having a cross section perpendicular to the direction that is polygonal, wherein the second extending member includes the inner peripheral edge thereof having a cross section perpendicular to the direction that is polygonal, and wherein the limiting section is inset into a corner of two adjacent sides of the outer periphery of the first extending member.

16. The length adjustable tool as claimed in claim 10, wherein the first extending member includes the outer periphery thereof having a cross section perpendicular to the direction that is polygonal, wherein the second extending member includes the inner peripheral edge thereof having a cross section perpendicular to the direction that is polygonal, and wherein the limiting section is defined on a flat side of the outer periphery of the first extending member.

17. The length adjustable tool as claimed in claim 2, wherein the first extending member includes an outer periphery thereof including length markings disposed in the direction from the first end to the second end thereof.

18. The length adjustable tool as claimed in claim 9, wherein the first extending member includes an outer periphery thereof including length markings disposed in Rail the direction from the first end to the second end thereof.

19. The length adjustable tool as claimed in claim 11, wherein the first extending member includes an outer periphery thereof including length markings disposed in Rail the direction from the first end to the second end thereof.

20. The length adjustable tool as claimed in claim 3, wherein the second extending member includes the outer peripheral edge thereof including a flange, and wherein the control member is restrained on the second extending member by the flange and the first abutting section.

* * * * *